US010175648B1

(12) United States Patent
Ju

(10) Patent No.: US 10,175,648 B1
(45) Date of Patent: Jan. 8, 2019

(54) PAPER SENSOR TO SENSE PAPER PASSING THROUGH FUSER

(71) Applicant: S-Printing Solution Co., Ltd., Suwon-si (KR)

(72) Inventor: Jeong-yong Ju, Suwon-si (KR)

(73) Assignee: HP PRINTING KOREA CO., LTD., Suwon-si (KR)

( * ) Notice: Subject to any disclaimer, the term of this patent is extended or adjusted under 35 U.S.C. 154(b) by 0 days.

(21) Appl. No.: 15/708,862

(22) Filed: Sep. 19, 2017

(30) Foreign Application Priority Data

Jul. 5, 2017 (KR) ..... 10-2017-0085267

(51) Int. Cl.
*G03G 21/20* (2006.01)

(52) U.S. Cl.
CPC ..... *G03G 21/206* (2013.01)

(58) Field of Classification Search
CPC ..... G03G 21/206
USPC ..... 399/92
See application file for complete search history.

(56) References Cited

U.S. PATENT DOCUMENTS

| | | | | |
|---|---|---|---|---|
| 4,849,796 | A | 7/1989 | Murakami | |
| 4,908,673 | A | 3/1990 | Muramatsu | |
| 5,882,130 | A | 3/1999 | Kumazaki et al. | |
| 6,149,324 | A | 11/2000 | Song | |
| 8,150,303 | B2 | 4/2012 | Kim et al. | |
| 9,025,973 | B2 | 5/2015 | Suzuki et al. | |
| 9,181,053 | B2 | 11/2015 | Tanonaka | |
| 2003/0215274 | A1 | 11/2003 | Ahn | |
| 2014/0212152 | A1* | 7/2014 | Suzuki | G03G 21/1633 399/16 |
| 2015/0042038 | A1 | 2/2015 | Shiina | |
| 2017/0082958 | A1* | 3/2017 | Hasebe | G03G 15/5029 |

FOREIGN PATENT DOCUMENTS

| | | |
|---|---|---|
| JP | 2016-216236 | 12/2016 |
| KR | 1020040087901 | 10/2004 |
| KR | 1020060069565 | 6/2006 |
| KR | 1020060073802 | 6/2006 |
| KR | 1020060082477 | 7/2006 |
| KR | 1020110074218 | 6/2011 |

* cited by examiner

*Primary Examiner* — Billy Lactaoen

(74) *Attorney, Agent, or Firm* — Staas & Halsey LLP

(57) ABSTRACT

An image forming apparatus includes a main body, a fan configured to discharge air inside the main body out of the main body, and a paper sensor arranged between a conveyance path of a paper that has passed through a fusing unit and the fan to sense the paper passing through the fusing unit, wherein a light sensing area of the paper sensing unit is open toward the fan.

20 Claims, 12 Drawing Sheets

PAPER SENSOR TO SENSE PAPER PASSING THROUGH FUSER

CROSS-REFERENCE TO RELATED APPLICATIONS

This application claims priority from Korean Patent Application No. 10-2017-0085267 filed on Jul. 5, 2017 in the Korean Intellectual Property Office, the disclosure of which is incorporated herein by reference in its entirety.

BACKGROUND

1. Field

The present disclosure relates to an image forming apparatus.

2. Description of the Related Art

As a kind of image forming apparatus, an electrophotographic image forming apparatus operates in such a manner that it forms an electrostatic latent image on a rotating photoreceptor through irradiating of light onto the photoreceptor by means of an exposure unit, forms a toner image on the surface of the photoreceptor through a supply of toner onto the photoreceptor on which the electrostatic latent image is formed by means of a developing unit, transfers the toner image of the photoreceptor onto a paper by means of a transfer unit, and then forms an image on the paper through pressing and heating of the toner image transferred onto the paper by means of a fusing unit.

In addition, the image forming apparatus may include a plurality of paper sensing units arranged on a conveyance path of the paper, and thus can sense movement of the paper that moves along the paper conveyance path for image forming and grasp the position of the paper jammed due to malfunction.

However, in the case of the paper sensing unit for sensing the paper that passes through the fusing unit, moisture that is evaporated by the fusing unit is condensed on the surface of a sensor, and thus light emission and light reception are not accurately performed to cause the performance of the sensor to deteriorate.

Specifically, the moisture included in the paper and the peripheral portion thereof is evaporated by high-temperature heat that is applied to the paper through the fusing unit, and the evaporated moisture is condensed on peripheral components having a temperature that is relatively lower than that of the fusing unit. In this case, the moisture that is evaporated by the fusing unit may also be condensed on a light emitting portion and a light receiving portion of the paper sensing unit for sensing the paper that passes through the fusing unit, and this may cause the performance of the sensor to deteriorate.

In addition, since the high-temperature heat is generated in the fusing process, the image forming apparatus includes a fan for discharging air in the image forming apparatus to outside.

The fan may be arranged in a specific position inside the image forming apparatus so as to easily discharge the high-temperature and high-humidity air existing around the fusing unit to the outside. Through such an operation of the fan, the high-temperature air and water vapor around the fusing unit flows out of the image forming apparatus through the fusing unit and the paper sensing unit. In this case, since the high-temperature air and water vapor come in direct contact with the sensor of the paper sensing unit, a plurality of water drops may be condensed on the light emitting portion and the light receiving portion of the sensor, and this may cause the performance of the paper sensing unit to deteriorate.

SUMMARY

Exemplary embodiments of the present disclosure overcome the above disadvantages and other disadvantages not described above, and provide an image forming apparatus which can improve the performance of paper sensing as well as having a compact structure.

According to an aspect of the present disclosure, an image forming apparatus includes a main body; a fan configured to discharge air from inside the main body to outside of the main body; and a paper sensor arranged between the fan and a conveyance path of paper that has passed through a fuser of the imaging forming apparatus, and configured to sense the paper passing through the fuser, wherein a light sensing area of the paper sensor is open toward the fan.

The paper sensor may include a sensor including a body portion having a first surface facing the conveyance path and a second surface facing the fan, a light emitting portion and a light receiving portion that are arranged on the second surface to be spaced apart from each other and to face each other; and a lever configured to be moved by the paper passing through the conveyance path to selectively block light irradiated from the light emitting portion toward the light receiving portion, wherein the light sensing area is formed between the light emitting portion and the light receiving portion.

The air inside the main body may flow from the conveyance path toward the fan, and the first surface may block a flow of the air moving from the conveyance path toward the light sensing area.

The image forming apparatus according to the aspect of the present disclosure may further include a support member configured to support the paper sensor and provided with a mount portion arranged between the conveyance path and the sensor to be coupled to the first surface, wherein a mount surface to which the first surface of the mount portion is coupled is configured to have an area that is larger than an area of the first surface.

The lever may include a first part configured to be pressed by the paper passing through the conveyance path to be rotated; and a second part configured to interlock with the first part to selectively block the light irradiated from the light emitting portion toward the light receiving portion.

The first part may be rotated in a first direction around a second end portion of the first part as a first end portion of the first part arranged on the conveyance path is moved by the paper passing through the conveyance path, and the second part may be moved by the first part being rotated in the first direction, so that a light blocking member that is inserted into the light sensing area moves in a direction in which the light blocking member extracts from the light sensing area.

The light blocking member may be coupled to a first end portion of the second part, the lever may further include a rotating shaft to which the second end portion of the first part and a second end portion of the second part are rotatably connected, and the second part may be rotated in the same direction as the direction of the first part as the second end portion of the second part is fastened to the second end portion of the first part in accordance with the rotation of the first part.

The lever may further include an elastic member configured to apply an elastic force to the first part so that the first part is rotated in a second direction that is opposite to the first direction when the paper is not in contact with the lever.

The light blocking member may release blocking of the light irradiated from the light emitting portion toward the light receiving portion as the second part is rotated in the first direction, and may block the light irradiated from the light emitting portion toward the light receiving portion as the second part is rotated in the second direction.

The first part may include first and second locking portions formed on the second end portion of the first part to be arranged along an outer circumference of the rotating shaft, and the second part may include third and fourth locking portions formed on the second end portion of the second part to be arranged between the first locking portion and the second locking portion along the outer circumference of the rotating shaft.

The first locking portion may move and press the third locking portion so that the second part is rotated in the first direction as the first part is rotated in the first direction, and the second locking portion may press the fourth locking portion so that the second part is rotated in the second direction as the first part is rotated in the second direction.

The first locking portion and the third locking portion may be arranged to be spaced apart from each other at a predetermined angle on the basis of a rotation center of the rotating shaft in a standby state so that a rotation angle of the second part is smaller than a rotation angle of the first part.

The second part may be extended from the rotating shaft toward the light sensing area, and at least a part of thr second part may be bent toward the light sensing area.

The first part may include a pressing member projecting from the second end portion the first part toward the second part, the second part may be arranged to be movable in a third direction in which the light blocking member extracts from the light sensing area and a fourth direction that is opposite to the third direction, the lever may further include an elastic member that applies an elastic force to the second part so that the second part moves in the fourth direction, and the pressing member may press the second part so that the second part moves in the third direction if the first part is rotated in the first direction.

The third and fourth directions may be set as a vertical direction against an installation surface of the main body or a horizontal direction against the installation surface of the main body.

Additional and/or other aspects and advantages of the disclosure will be set forth in part in the description which follows and, in part, will be obvious from the description, or may be learned by practice of the disclosure.

BRIEF DESCRIPTION OF THE DRAWINGS

The above and/or other aspects of the present disclosure will be more apparent by describing certain exemplary embodiments of the present disclosure with reference to the accompanying drawings, in which.

DETAILED DESCRIPTION

Figure 1:
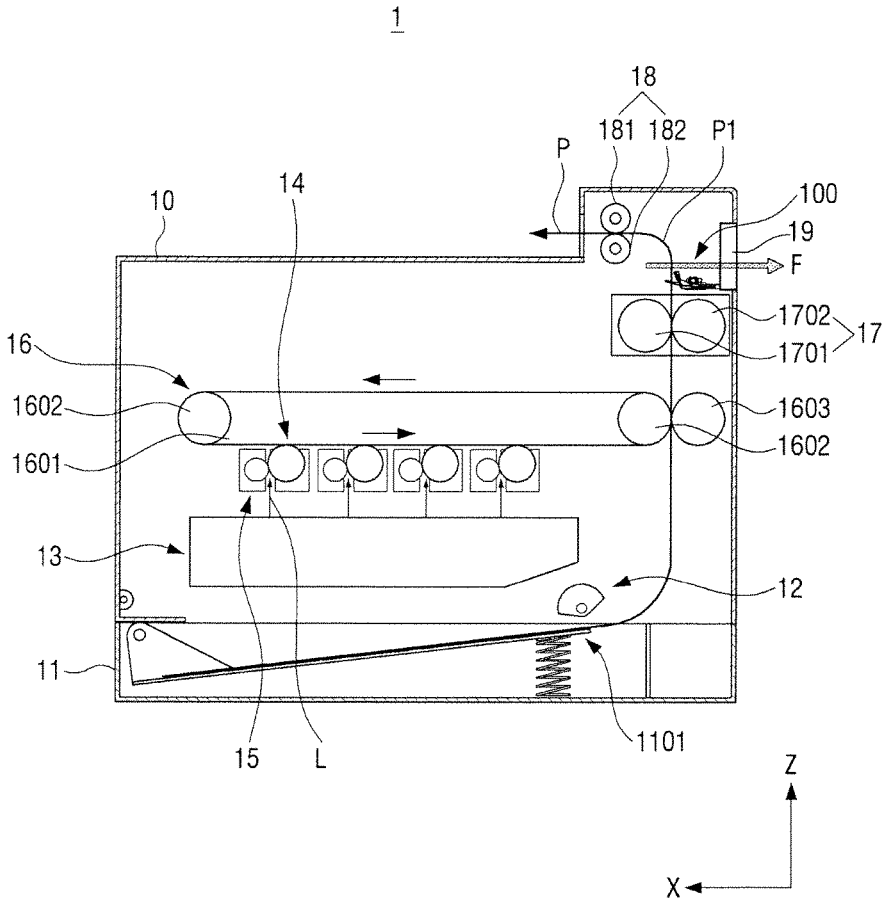
FIG. 1 is a view schematically illustrating the structure of an image forming apparatus according to an embodiment of the present disclosure.

Hereinafter, exemplary embodiments of the present disclosure will be described in detail with reference to the accompanying drawings. The following description with reference to the accompanying drawings is provided to assist in a comprehensive understanding of the technical features of the present disclosure. However, the technical features of the present disclosure are not limited by the embodiments, but it is exemplified that the present disclosure may be implemented by the specific embodiments to be described hereinafter.

Accordingly, those of ordinary skill in the art will recognize that various changes and modifications of the various embodiments described herein can be made without departing from the scope and spirit of the present disclosure. In addition, like drawing reference numerals are used for the like elements, even in different drawings. Also, well-known functions or constructions are not described in detail since they would obscure the application with unnecessary detail. In order to help understanding of the present disclosure, sizes of some constituent elements illustrated in the drawings may be exaggerated for clarity in explanation.

FIG. 1 is a view schematically illustrating the structure of an image forming apparatus 1 according to an embodiment of the present disclosure An image forming apparatus 1 according to the present disclosure may be implemented by a printer, a copy machine, a scanner, or a facsimile, and it may be an MFP (Multi-Function Peripheral) in which the functions of the printer, copy machine, scanner, and facsimile are compositely implemented through one device.

As illustrated in FIG. 1, the image forming apparatus 1 includes a main body 10 that forms an external appearance of the image forming apparatus. A paper feeding cassette 11 may be coupled to a lower end of the main body 10 to supply a loaded paper to the interior of the main body 10, and a pickup unit 12, an exposure unit 13, a photoreceptor 14, a developing unit 15, a transfer unit 16, a fuser 17, a paper discharge unit 18, a fan 19, and a paper sensor 100 may be arranged inside the main body 10.

The paper feeding cassette 11 is provided with an accommodation space for loading papers therein, and is separably coupled to a lower portion of the main body 10. The paper feeding cassette 11 includes a pickup plate 1101 configured to elastically support papers loaded therein toward the pickup unit 12.

The pickup unit 12 may pick up and convey the papers to a conveyance path P in the main body 10. That is, the pickup unit 12 may pick up the papers loaded in the paper feeding cassette 11 sheet by sheet, and may put the picked papers into the conveyance path P. The pickup unit 12 may include a pickup roller configured to pick up the papers sheet by sheet and a plurality of conveyance rollers arranged on the conveyance path P.

Although FIG. 1 illustrates an example in which a single paper feeding cassette 11 is separably coupled to the lower portion of the main body 10, a plurality of paper feeding cassettes 11 may be provided. In addition, the image forming apparatus 1 may further include a multipurpose tray coupled to a side surface or an upper portion of the main body 10 to supply the paper into the main body 10.

The exposure unit 13 forms an electrostatic latent image on the surface of the photoreceptor 14 through irradiation of light L including image information onto the photoreceptor 14, and the developing unit 15 forms a toner image through supply of toner onto the photoreceptor 14 on which the electrostatic latent image is formed.

The photoreceptor 14 or the developing unit 15 may be configured as a single element, and as illustrated in FIG. 1, plural elements, for example, four elements, may be configured in accordance with colors of toner.

The developing unit 15 may be composed of four developing units including color toners of cyan (C), magenta (M), yellow (Y), and black (K), and four photoreceptors 14 may also be configured corresponding to the four developing units 15.

Through this, visible toner images of cyan (C), magenta (M), yellow (Y), and black (K) may be formed on respective surfaces of the four photoreceptors 14.

The transfer unit 16 includes a transfer belt 1601, a rotating roller 1602 configured to support and rotate the transfer belt 1601, and a transfer roller 1603 facing the transfer belt 1601 and forming a nip through which the paper passes.

As illustrated in FIG. 1, a plurality of rotating rollers 1602 may be configured to maintain a tension of the transfer belt 1601 at both ends of an inner side of the transfer belt 1601 and to rotate the transfer belt 1601 as well. In addition, the rotating roller 1602 may be composed of three or more rollers.

The transfer belt 1601 is rotated in a state where it comes in contact with the photoreceptor 14, and the respective toner images of the four photoreceptors 14 may be successively transferred onto the transfer belt 1601.

The toner image that is formed on the transfer belt 1601 may be transferred onto the paper that passes between the transfer belt 1601 and the transfer roller 1603.

The fuser 17 includes first and second fusing rollers 1701 and 1702. The fuser 17 may fuse the toner image that is transferred onto the paper through pressing and heating the paper that passes between the first and second fusing rollers 1701 and 1702 being rotated.

For this, the first fusing roller 1701 may be composed of a heating roller configured to heat the paper, and the second fusing roller 1702 may be composed of a pressing roller configured to pressingly rotate the first fusing roller 1701. The first fusing roller 1701 includes a heat source, such as a halogen lamp, provided therein. Further, the first fusing roller 1701 may be in a belt structure in addition to the roller shape.

The paper discharge unit 18 includes first and second paper discharge rollers 181 and 182. The paper on which the toner image is fused by the fuser 17 may pass between the first and second paper discharge rollers 181 and 182 being rotated to be discharged out of the image forming apparatus 1.

Since the paper feeding cassette 11, the pickup unit 12, the exposure unit 13, the photoreceptor 14, the developing unit 15, the transfer unit 16, the fuser 17, and the paper discharge unit 18 of the image forming apparatus 1 as described above are the same as or similar to those in the related art, a detailed explanation thereof will be omitted.

The fan 19 may be coupled to an exhaust port of the main body 10 to discharge air inside the main body 10 out of the main body 10. The fan 19 may be an exhaust fan being generally used.

The air inside the main body 10 has a high temperature around the fuser 17 that generates high-temperature heat, and the high-temperature heat that is applied to the paper through the fuser 17 evaporates moisture included in the paper and the peripheral portion thereof. The evaporated moisture may be condensed on peripheral components having a temperature that is relatively lower than that of the fuser 17.

Accordingly, it is preferable that the fan 19 is arranged adjacent to the fuser 17 so as to effectively discharge the high-temperature air and water vapor inside the main body 10 to outside, and it is more preferable that the fan 19 is arranged near to a conveyance path P1 of the paper having passed through the fuser 17.

Through this, the fan 19 can easily discharge the high-temperature air and water vapor generated during the operation of the fuser 17 out of the main body 10.

The paper sensor 100 may include a lever 120 (in FIG. 2) arranged on the conveyance path P1 of the paper having passed through the fuser 17 so as to sense the paper having passed through the fuser 17, and it may sense the paper having passed through the fuser 17 as the lever 120 is pressed by the paper having passed through the fuser 17.

As illustrated in FIG. 1, the paper sensor 100 may be arranged between the conveyance path P1 of the paper having passed through the fuser 17 and the fan 19 to sense the paper having passed through the fuser 17. The detailed structure of the paper sensor 100 will be described later.

The high-temperature air and water vapor heated through the fuser 17 may make a flow F from the conveyance path P1 toward the fan 19 through the paper sensor 100, and may be discharged out of the main body 10 through the fan 19.

Figure 2:
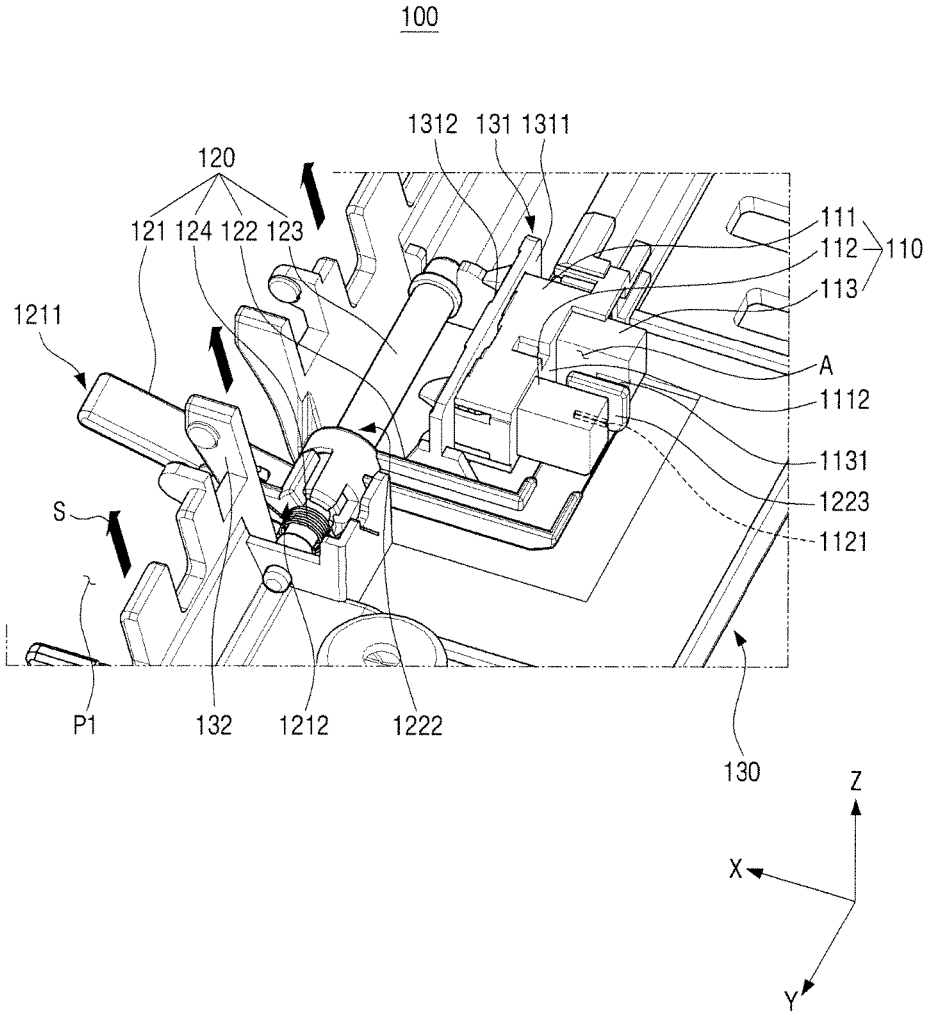
FIG. 2 is an enlarged perspective view of an interior of an image forming apparatus as illustrated in FIG. 1, in which a paper sensor is arranged.
Figure 3:
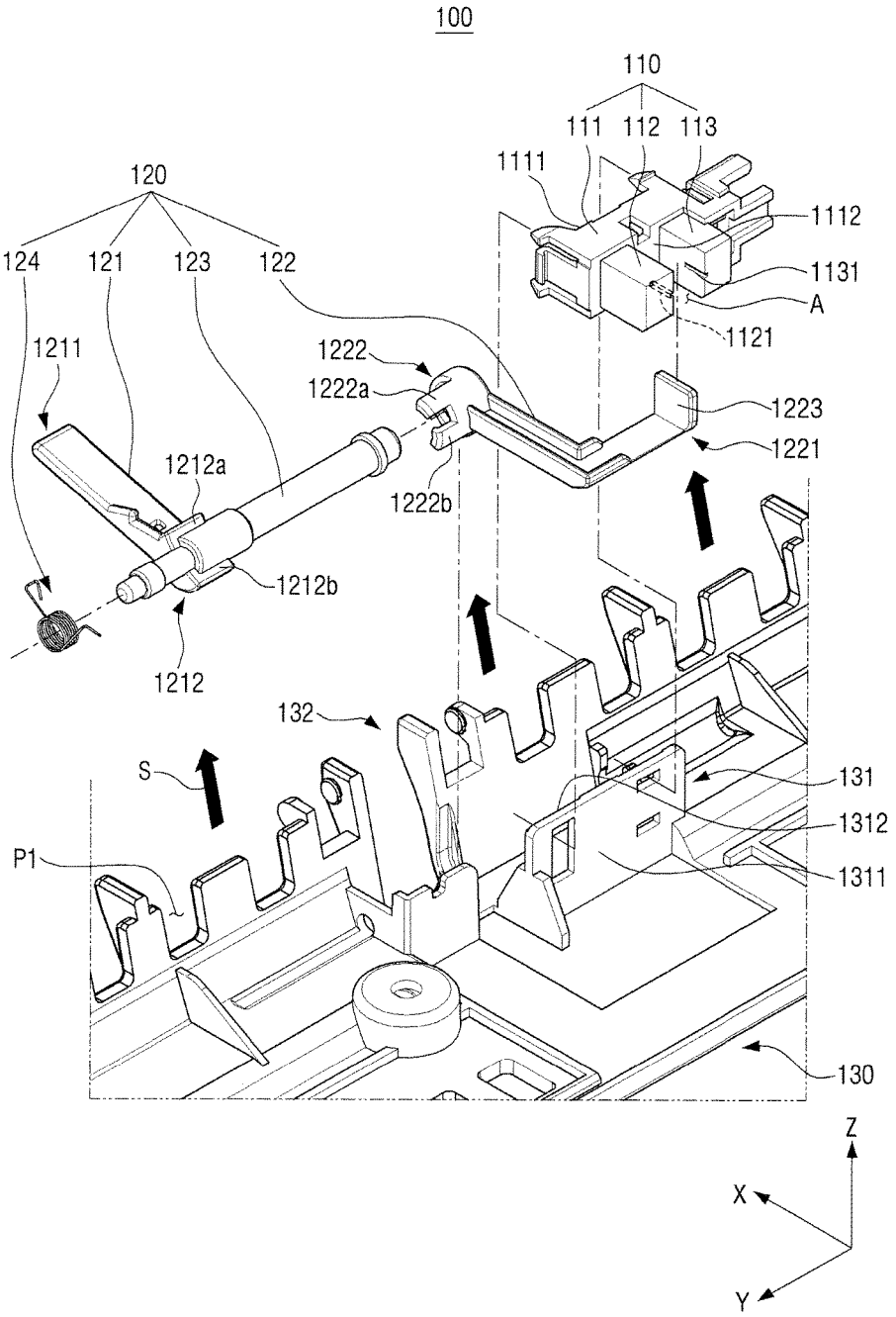
FIG. 3 is an exploded perspective view of the paper sensor as illustrated in FIG. 2.

FIG. 2 is an enlarged perspective view of an interior of an image forming apparatus 1 as illustrated in FIG. 1, in which a paper sensor 100 is arranged, and FIG. 3 is an exploded perspective view of the paper sensor 100 as illustrated in FIG. 2.

Hereinafter, referring to FIGS. 2 and 3, the detailed structure of the paper sensor 100 will be described.

The paper sensor 100 includes a sensor 110 and a lever 120.

The lever 120 may be pressed by the paper passing through the fuser 17 so as to selectively block light irradiated onto a light sensing area A of the sensor 110, and the sensor 110 may sense the paper passing through the fuser 17 through sensing whether the light irradiated onto the light sensing area A is blocked.

Specifically, the sensor 110 includes a body portion 111, a light emitting portion 112, and a light receiving portion 113.

The body portion 111 includes a first surface 1111 directed to the conveyance path P1 and a second surface 1112 directed to the fan 19, and the light emitting portion 112 and the light receiving portion 113 are arranged on the second surface 1112 to be spaced apart from each other and to face each other.

The light emitting portion 112 that is coupled to the second surface 1112 includes a light emitting element 1121 arranged on one side to face the light receiving unit 113, and the light receiving unit 113 arranged to face the light emitting portion 112 includes a light receiving element 1131 arranged in a position corresponding to the light emitting element 1121 on one side that faces the light emitting portion 112.

The light emitting element 1121 may emit light toward the light receiving element 1131 facing the light emitting element 1121, and the light receiving element 1131 may sense the light irradiated from the light emitting element 1121.

The light that is emitted from the light emitting element 1121 may be infrared rays, ultraviolet rays, or visible light, and may be waves, such as ultrashort waves, radio waves, or ultrasonic waves.

In addition, the light emitting element 1121 may include a light emitting diode LED, or a laser diode LD, and the light receiving element 1131 may include a photodiode PD or an avalanche photodiode APD.

The light sensing area A is formed between the light emitting portion 112 and the light receiving portion 113, and the light that is emitted from the light emitting element 1121 may be incident to the light receiving element 1131 after passing through the light sensing area A. The light sensing area A is a space in which the light emitting portion 112 and the light receiving region 113 face each other, and may be defined as a space through which the light irradiated from the light emitting portion 112 toward the light receiving portion 113 passes.

Since the light emitting portion 112 and the light receiving portion 113 are coupled to the second surface 1112 that is directed to the fan 19, the light sensing area A may be open toward the fan 19.

That is, the light sensing area A is configured so that one side thereof that is directed toward the conveyance path P1 is blocked by the body portion 111.

Accordingly, even if the high-temperature and high-humidity air inside the main body 10 flows from the conveyance path P1 toward the sensor 110 arranged between the conveyance path P1 and the fan 19 by the fan 19, an air flow that is directed toward the light sensing area A may be blocked.

Specifically, the water vapor that is formed around the conveyance path P1 by the operation of the fuser 17 flows from the conveyance path P1 toward the sensor 110 by the operation of the fan 19. However, the flow of the water vapor that flows toward the sensor 110 is blocked through collision with the first surface 1111 of the body portion 111.

Since the light sensing area A is open in a direction directed to the fan 19, which is opposite to a direction facing the conveyance path P1, but it is blocked by the body portion 111 in the direction facing the conveyance path P1, the flow F (in FIG. 1) of the water vapor that moves toward the sensor 110 is unable to directly flow into the light sensing area A.

Accordingly, the flow F of the water vapor that moves from the conveyance path P1 toward the fan 19 by the fan 19 collides with the first surface 1111 to move toward the fan 19, and the water vapor is unable to flow between the light emitting portion 112 and the light receiving portion 113 that is coupled to the second surface 1112 directed to the fan 19.

Through this, the water vapor does not flow directly into the light sensing area A, and thus the water vapor is prevented from being condensed on the light emitting element 1121 and the light receiving element 1131. Accordingly, the light that is emitted from the light emitting element 1121 may be easily irradiated onto the light receiving element 1131, and the light that is incident to the light receiving element 1131 may be easily sensed by the light receiving element 1131. Through this, it is possible to prevent malfunction of the sensor 110 due to the water vapor generated during the operation process of the fuser 17.

In addition, a support member 130 configured to support the paper sensor 100 may be arranged inside the main body 10.

The support member 130 may be in the form of a bracket that is coupled to the inside of the main body 10, and in addition to the paper sensor 100, various components may be coupled to the support member 130.

The support member 130 is arranged between the conveyance path P1 and the fan 19.

As illustrated in FIGS. 2 and 3, the support member 130 includes a mount portion 131 mounted with the sensor 110.

The mount portion 131 may be in the form of a rib that projects from a bottom surface of the support member 130, and the first surface 1111 of the body portion 111 may be mounted on a mount surface 1311 that is directed to the fan 19.

In addition, a surface 1312 that is opposite to the mount surface 1311 is directed toward the conveyance path P1 to block the air flow from the conveyance path P1 toward the sensor 110.

Further, the mount surface 1311 may be configured to have an area that is larger than that of the first surface 1111. Accordingly, the air flow toward the sensor 110 may be primarily blocked through the mount portion 131.

In addition, the support member 130 may include a plurality of paper guides 132 arranged on the conveyance path P1, and the plurality of paper guides 132 may guide the movement of the paper that passes through the conveyance path P1 after passing through the fuser 17.

Hereinafter, the structure of the lever 120 will be described in detail.

The lever 120 may be rotated as one end portion thereof is pressed by the paper that passes through the conveyance path P1, and a part thereof may be inserted into the light sensing area A or may extract from the light sensing area A in accordance with the rotation of the lever 120.

If a part of the lever 120 is inserted into the light sensing area A, the lever 120 may block the light that is irradiated from the light emitting portion 112 toward the light receiving portion 113, whereas if the part of the lever 120 extracts from the light sensing area A, blocking of the light that is irradiated from the light emitting portion 112 toward the light receiving portion 113 is released.

As described above, the lever 120 is pressed to be rotated by the paper passing through the conveyance path P1 to selectively block the light that is irradiated from the light emitting portion 112 toward the light receiving portion 113, and thus it is possible to determine whether the paper passes through the conveyance path P1 depending on whether the light receiving portion 113 senses the light.

Specifically, the lever 120 includes a first part 121 configured to be pressed by the paper passing through the conveyance path P1 to be rotated, a second part 122 configured to interlock with the first part 121 to selectively block the light irradiated from the light emitting portion 112 toward the light receiving unit 113, and a rotating shaft 123 to which the first part 121 and the second part 122 are rotatably connected.

As illustrated in FIGS. 2 and 3, the first and second parts 121 and 122 may be in the form of a lever being extended from the rotating shaft 123, and the rotating shaft 123 may be arranged in a direction that is vertical to a moving direction S of the paper passing through the conveyance path P1.

One end portion 1211 of the first part 121 may be arranged on the conveyance path P1 to be pressed by the paper passing through the conveyance path P1, and through this, the first part 121 may be rotated around the other end portion 1212 that is opposite to one end portion 1211 thereof.

Hereinafter, for convenience in explanation, a direction in which the first part 121 is rotated as the one end portion 1211 of the first part 121 is pressed by the paper passing through the conveyance path P1 is called a first direction, and a direction that is opposite to the first direction is called a second direction. For example, the first direction may be set to a clockwise direction, and the second direction may be set to a counterclockwise direction.

The second part 122 may be pressed by the first part 121 that is pressed by the paper to be rotated, and a portion thereof that is inserted into the light sensing area A may move in a direction in which it extracts from the light sensing area A.

The second part 122 includes a light blocking member 1223 arranged on one end portion 1221 of the second part 122, and the light blocking member 1223 is formed to project in a direction that is directed from the one end portion 1221 of the second part 122 toward the light sensing area A so as to be inserted into the light sensing area A.

The other end portion 1212 of the first part 121 and the other end portion 1222 of the second part 122 are rotatably connected to the rotating shaft 123.

The other end portion 1212 of the first part 121 and the other end portion 1222 of the second part 122 are connected to the rotating shaft 123 so that they are independently rotated.

In addition, as illustrated in FIGS. 2 and 3, the first part 121 may be integrally configured with the rotating shaft 123, and the other end portion 1212 of the first part 121 and the rotating shaft 123 may be integrally formed.

Further, the other end portion 1212 of the first part 121 and the other end portion 1222 of the second part 122 are configured to be fastened to each other on the rotating shaft 123 in accordance with the rotation of the first part 121. Accordingly, the second part 122 may be rotated in the same direction as the direction of the first part 121 by the rotation of the first part 121.

Specifically, as illustrated in FIG. 3, the first part 121 includes first and second locking portions 1212*a* and 1212*b* that are formed on the other end portion 1212 of the first part 121 and are arranged along an outer circumference of the rotating shaft 123. In addition, the second part 122 includes third and fourth locking portions 1222*a* and 1222*b* that are formed on the other end portion 1222 of the second part 122 and are arranged between the first locking portion 1212*a* and the second locking portion 1212*b* along the outer circumference of the rotating shaft 123.

If the first part 121 is rotated in the first direction, the first locking portion 1212*a* presses the third locking portion 1222*a* in the first direction, and through this, the second part 122 may be rotated in the first direction. In addition, if the first part 121 is rotated in the second direction, the second locking portion 1212*b* presses the fourth locking portion 1222*b* in the second direction, and through this, the second part 122 may be rotated in the second direction.

A structure in which the first part 121 and the second part 122 interlock with each other to be rotated will be described later.

As illustrated in FIGS. 2 and 3, the light blocking member 1223 is coupled to one end portion 1221 of the second part 122, and may be inserted into the light sensing area A or may extract from the light sensing area A in accordance with the rotation of the second part 122.

The other end portion 1222 of the second part 122 is rotatably connected to the rotating shaft 123, and at least a part of the second part 122 may be bent so that the light blocking member 1223 that is coupled to the one end portion 1221 can be inserted into the light sensing area A. That is, the second part 122 may be in the form of a bar being extended from the rotating shaft 123 toward the light sensing area A, and at least a part of the second part 122 may be bent toward the light sensing area A.

If the paper does not pass through the conveyance path P1, the light blocking member 1223 is inserted into the light sensing area A to block the light irradiated from the light emitting portion 112 toward the light receiving portion 113. Since the light is not sensed by the light receiving portion 113, a controller (not illustrated) may determine that no paper is on the conveyance path P1, and may determine that the paper does not pass through the fuser 17.

In addition, if the paper passes through the conveyance path P1, the first part 121 is rotated in the first direction, and the second part 122 is rotated in the first direction by the first part 121. Accordingly, the light blocking member 1223 is rotated in a direction in which it extracts from the light sensing area A to release the blocking of the light irradiated from the light emitting portion 112 toward the light receiving portion 113. Since the light is sensed by the light receiving portion 113, the controller may determine that the paper is moving on the conveyance path P1, and may determine that the paper is passing through the fuser 17.

In addition, the lever 120 further includes an elastic member 124 configured to apply an elastic force to the first part 121 so that the first part 121 is rotated in the second direction that is opposite to the first direction.

As described above, since the paper passing through the conveyance path P1 presses the one end portion 1211 of the first part 121, the first part 121 is rotated in the first direction. Thereafter, if the whole paper has passed through the conveyance path P1, the pressing of the one end portion 1211 of the first part 121 is released, and the first part 121 is rotated in the second direction by the elastic force of the elastic member 124. Through this, the first part 121 may maintain a standby state where the paper does not pass through the conveyance path P1.

In addition, since the second part 122 is rotated in the same direction as the direction of the first part 121 by the first part 121, the second part 122 is rotated in the second direction as the first part 121 is rotated in the second direction. Accordingly, the light blocking member 1223 is again inserted into the light sensing area A to block the light irradiated from the light emitting portion 112 toward the light receiving portion 113.

Figure 4A:
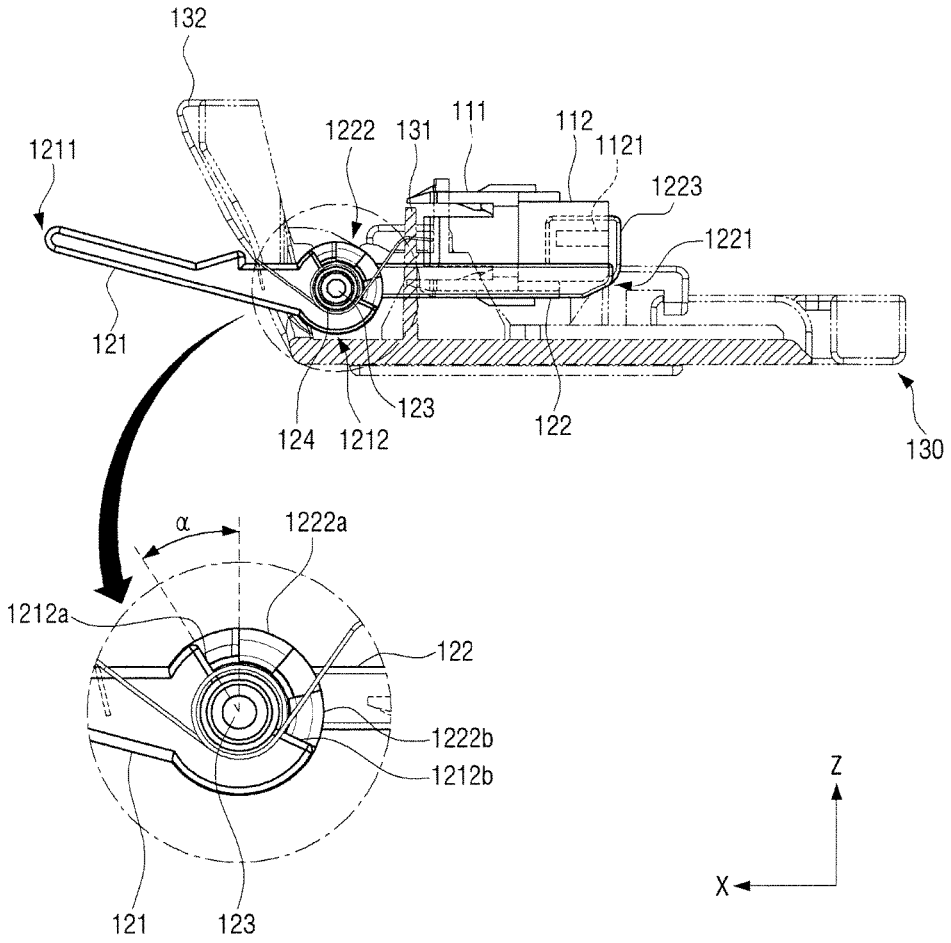
FIGS. 4A to 4C are side views explaining an operation process of a paper sensor according to an embodiment of the present disclosure.
Figure 4B:
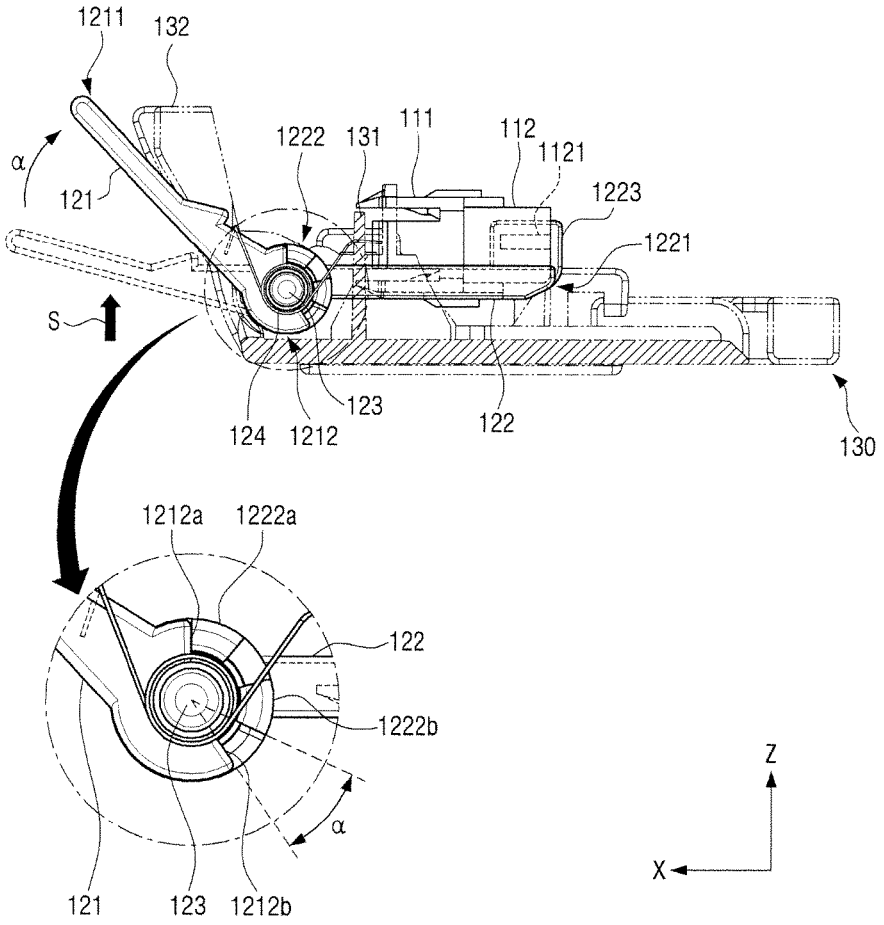
Figure 4C:
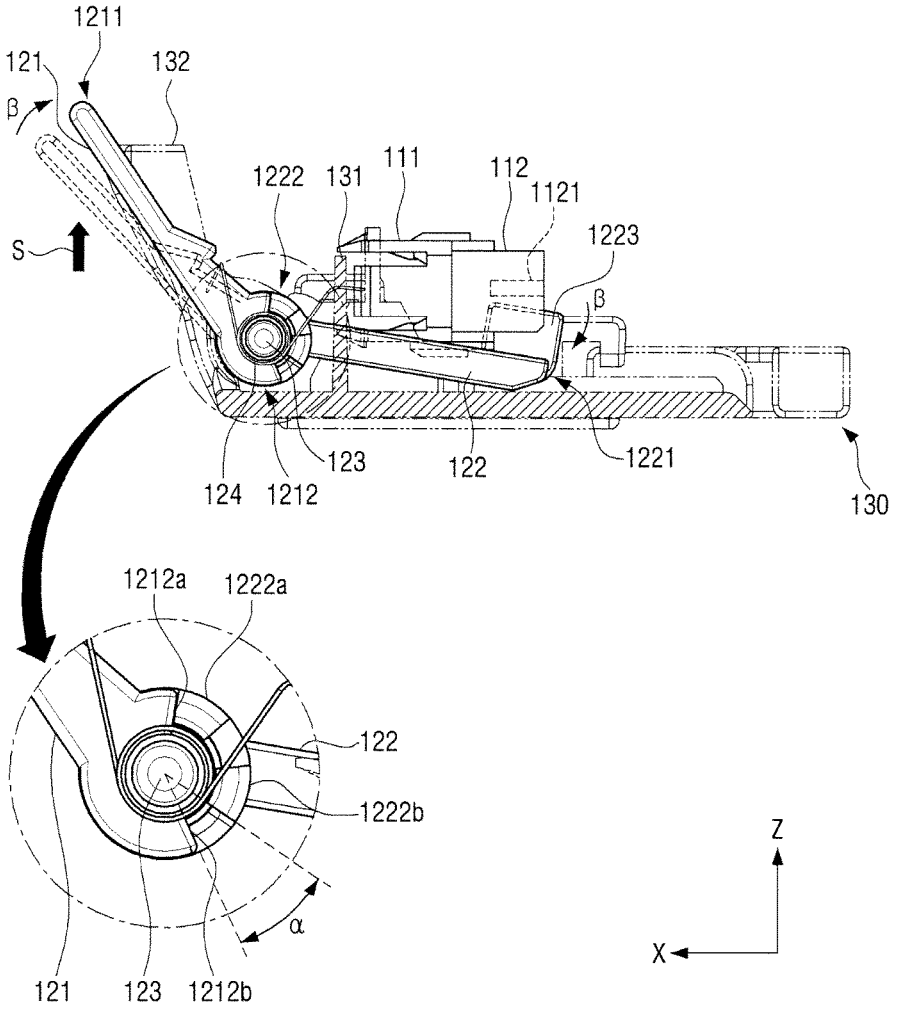

FIGS. 4A to 4C are side views explaining an operation process of a paper sensor 100 according to an embodiment of the present disclosure.

Hereinafter, the operation process of the paper sensor 100 will be described in detail around a structure in which the first part 121 and the second part 122 interlock with each other.

FIG. 4A illustrates a state where no paper is on the conveyance path P1 since the paper does not pass through the fuser 17. The state where no paper is on the conveyance path P1 may be called a standby state.

In a standby state, the first part 121 receives an elastic force that is applied from the elastic member 124 to maintain a state where one end portion 1211 is rotated to project onto the conveyance path P1, and the light blocking member 1223 blocks the light irradiated from the light emitting portion 112 toward the light receiving portion 113 in a state where it is inserted into the light sensing area A.

Further, the first locking portion 1212*a* and the third locking portion 1222*a* are arranged to be spaced apart from each other at a predetermine angle on the basis of a rotation center of the rotating shaft 123 on the basis of a standby state so that a rotation angle of the second part 122 is smaller than a rotation angle of the first part 121.

Specifically, in the standby state, the first locking portion 1212*a* and the third locking portion 1222*a* are arranged to be spaced apart from each other at a first angle α on the basis of the rotation center of the rotating shaft 123. Further, in the standby state, the second locking portion 1212*b* and the fourth locking portion 1222*b* come in contact with each other.

FIG. 4B illustrates an initial state where the paper having passed through the fuser 17 enters into the conveyance path P1.

As the paper having entered into the conveyance path P1 moves along the moving direction S, the front end portion of the paper presses one end portion 1211 of the first part 121, and the first part 121 starts its rotation in the first direction. As illustrated in FIG. 4B, the first direction may be set to the clockwise direction.

In this case, it is preferable that an elastic force of the elastic member 124 is set to be lower than a force for the paper to press one end portion 1211 of the first part 121.

While the first part 121 is rotated at the first angle α, the first locking portion 1212*a* is rotated at the first angle α toward the third locking portion 1222*a*.

However, while the first part 121 is rotated at the first angle α, the first locking portion 1212*a* does not press the third locking portion 1222*a*, and thus the second part 122 is not rotated to maintain its position.

Since the first part 121 is rotated at the first angle α, the first locking portion 1212*a* and the third locking portion 1222*a* come in contact with each other, and the second locking portion 1212*b* and the fourth locking portion 1222*b* are spaced apart from each other at the first angle α.

As described above, at an initial state where the paper having entered into the conveyance path P1 moves along the moving direction S, only the first part 121 is rotated at the first angle α, but the second part 122 is not rotated.

Thereafter, as illustrated in FIG. 4C, since the paper further moves along the moving direction S, the first part 121 is additionally rotated as large as a second angle β, and the front end portion of the paper passes through one end portion 1211 of the first part 121.

While the paper passes through the conveyance path P1, the first part 121 maintains a state where it is rotated at a third angle α+β that is the sum of the first angle α and the second angle β.

Since the first part 121 is additionally rotated as large as the second angle β, the first locking portion 1212*a* presses the third locking portion 1222*a* in the first direction. Accordingly, the second part 122 is rotated as large as the second angle β in the first direction.

Accordingly, as illustrated in FIG. 4C, the light blocking member 1223 arranged on one end portion 1221 of the second part 122 is rotated as large as the second angle β in the first direction, and is rotated in a direction in which it extracts from the light sensing area A.

Accordingly, the light blocking member 1223 releases the blocking of the light irradiated from the light emitting portion 112 toward the light receiving portion 113.

The controller may determine that the paper passes through the conveyance path P1 after passing through the fuser 17 through sensing of the light by the light receiving portion 113.

While the paper passes through the conveyance path P1, the second part 122 maintains a state where it is rotated as large as the second angle β in the first direction, and thus the light receiving portion 113 can continuously sense the light that is irradiated from the light emitting portion 112. In addition, the controller may determine that the paper has completely passed through the conveyance path P1 through interruption of the light sensing.

As illustrated in FIGS. 4A to 4C, the second part 122 may be configured to be rotated only at the minimum angle enough to make the light blocking member 1223 selectively block the light irradiated from the light emitting element 1121 toward the light receiving element 1131. Through this, the rotating radius of the second part 122 can be minimized, and the overall size of the paper sensor 100 can be minimized.

Accordingly, as the second part 122 is rotated in the first direction, the light blocking member 1223 may not extract from the light sensing area A as a whole, but only a part thereof may extract from the light sensing area A so that the light is irradiated from the light emitting element 1121 toward the light receiving element 1131.

The second angle β at which the second part 122 is rotated in the first direction may be set to the minimum angle enough to make the light blocking member 1223 selectively block the light irradiated from the light emitting element 1121 toward the light receiving element 1131, and through this, a compact paper sensing unit 100 can be configured.

Thereafter, if the whole paper has passed through the conveyance path P1, pressing of one end portion 1211 of the first part 121 is released, and the first part 121 is rotated as large as the third angle α+β in the second direction by the elastic force of the elastic member 124.

While the first part 121 is rotated as large as the first angle α in the second direction, the second part 122 is not rotated. Thereafter, while the first part 121 is additionally rotated as large as the second angle β in the second direction, the fourth locking portion 1222*b* is pressed by the second locking portion 1212*b*, and the second part 122 is rotated as large as the second angle β in the second direction.

Through this, the paper sensor 100 may return to the standby state.

In addition, as the light is sensed by the light receiving portion 113, the controller determines that the paper has entered into the conveyance path P1, and if the light is continuously sensed by the light receiving portion 113 over a predetermined time, it may determine that the paper is jammed on the conveyance path P1 to stop the operation of the image forming apparatus 1.

As described above, the paper sensor 100 according to an embodiment of the present disclosure is configured to open the light sensing area A toward the fan 19 that is opposite to the conveyance path P1. Accordingly, the water vapor can be prevented from directly flowing into the light sensing area A, and the water vapor can be prevented from being condensed on the light emitting element 1121 and the light receiving element 1131.

In addition, since the lever 120 includes the first part 121 and the second part 122 that are separately configured to interlock with each other, the rotation angle of the second part 122 may be set to be smaller than the rotation angle of the first part 121. Further, by configuring the rotating angle of the second part 122 as the minimum angle enough to make the light blocking member 1223 selectively block the light, a compact paper sensor 100 can be configured.

Figure 5:
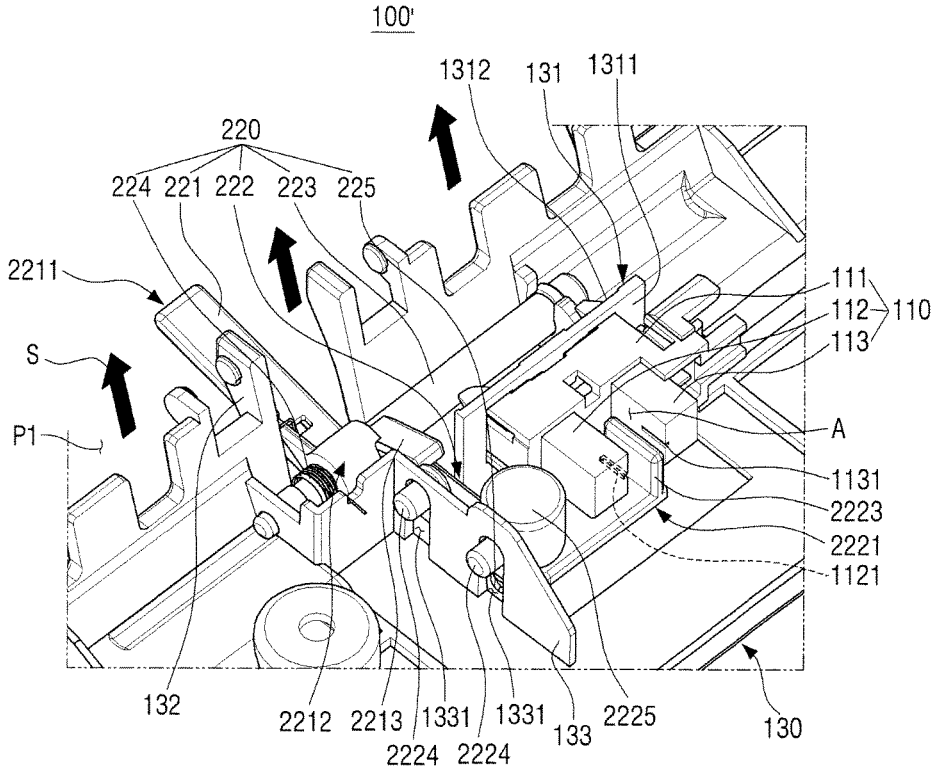
FIG. 5 is an enlarged perspective view of an interior of an image forming apparatus including a paper sensor according to another embodiment of the present disclosure.
Figure 6A:
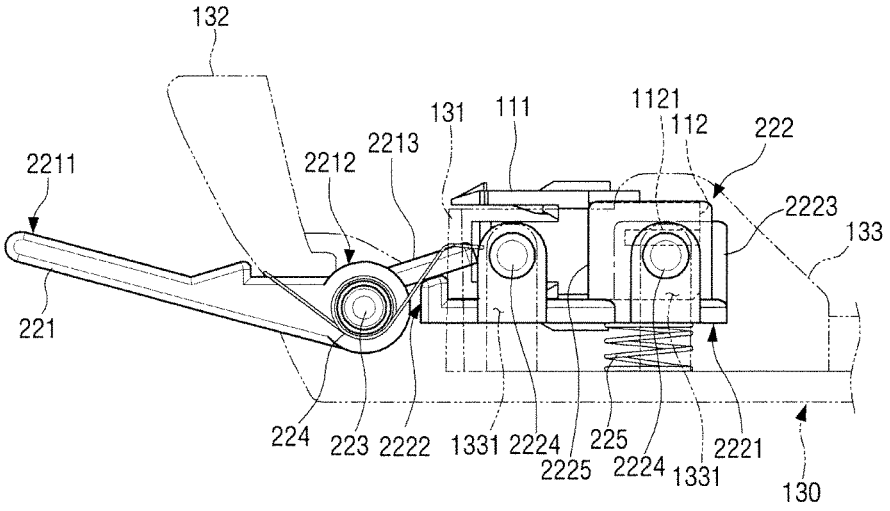
FIGS. 6A and 6B are side views explaining an operation process of a paper sensor as illustrated in FIG. 5.
Figure 6B:
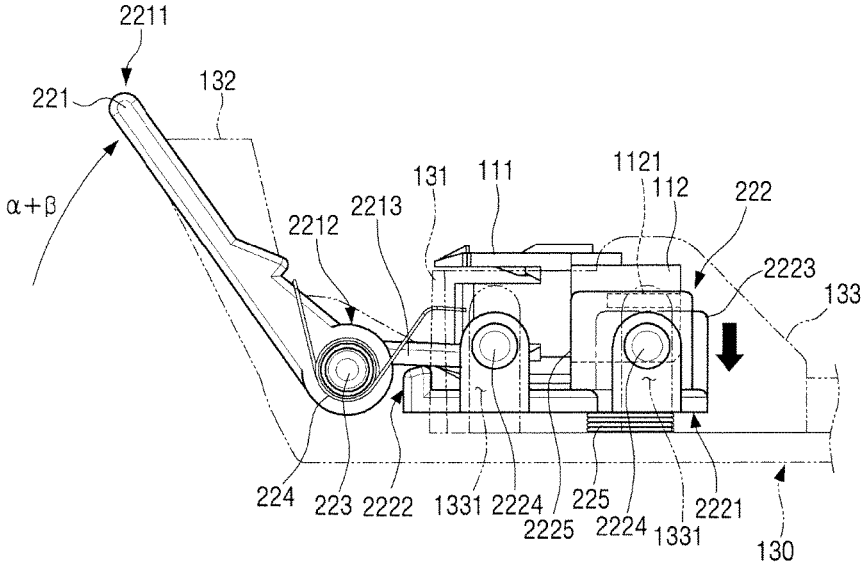

FIG. 5 is an enlarged perspective view of an interior of an image forming apparatus 1 including a paper sensor 100' according to another embodiment of the present disclosure, and FIGS. 6A and 6B are side views explaining the operation process of the paper sensor 100' as illustrated in FIG. 5.

Hereinafter, referring to FIGS. 5 to 6B, a paper sensor 100' according to another embodiment of the present disclosure will be described.

Since the most configurations of the paper sensor 100' according to another embodiment of the present disclosure are the same as those of the paper sensor 100 as illustrated in FIGS. 2 and 3, a duplicate explanation thereof will be omitted, and explanation will be made around the difference from the paper sensor 100 according to an embodiment of the present disclosure.

The paper sensor 100' includes a sensor 110 and a lever 220, and the sensor 110 is the same as the sensor 110 as illustrated in FIGS. 2 and 3.

The lever 220 includes a first part 221 configured to be pressed by the paper passing through the conveyance path P1 to be rotated, a second part 222 configured to interlock with the first part 221 to selectively block the light irradiated from the light emitting portion 112 toward the light receiving unit 113, and a rotating shaft 223 to which the first part 221 are rotatably connected.

One end portion 2211 of the first part 221 may be arranged on the conveyance path P1 to be pressed by the paper passing through the conveyance path P1, and through this, the first part 221 may be rotated around the rotating shaft 223 in the first direction.

In addition, the first part 221 further includes a first elastic member 224 configured to apply an elastic force to the first part 221 so that the first part 221 is rotated in the second direction that is opposite to the first direction.

A pressing member 2213 that projects toward the second part 222 is arranged on the other end portion 2212 of the first part 221.

If the first part 221 is rotated in the first direction by the paper passing through the conveyance path P1, the pressing member 2213 may press the second part 222, and through this, the second part 222 may move in a direction in which a part of the second part 222 inserted into the light sensing area A extracts from the light sensing area A.

The second part 222 includes a light blocking member 2223 arranged on one end portion 2221 of the second part 222, and the light blocking member 2223 is formed to project in a direction that is directed from the one end portion 2221 of the second part 222 toward the light sensing area A so as to be inserted into the light sensing area A.

In addition, the other end portion 2222 of the second part 222 comes in contact with the pressing member 2213, and may be pressed by the pressing member 2213 as the first part 221 is rotated in the first direction.

A second elastic member 225 is coupled to a lower portion of the second part 222.

The second elastic member 225 connects the support member 130 and the second part 222 to each other to support the second part 222 so that the second part 222 can move in a vertical direction against the installation surface of the main body 10.

Hereinafter, for convenience in explanation, a direction in which the second part 222 moves in a lower direction that is vertical to the installation surface of the main body 10 is called a third direction, and a direction that is opposite to the third direction is called a fourth direction.

In addition, the second part 222 may further include an accommodation portion 2225 capable of accommodating the second elastic member 225 therein.

The support member 130 configured to support the paper sensor 100' includes a mount portion 131 and a paper guide 132, and further includes a guide portion 133 configured to guide the movement of the second part 222.

The guide portion 133 may be in the form of a rib that projects from a bottom surface of the support member 130, and includes at least one guide groove 1331 formed in a vertical direction.

As illustrated in FIG. 5, the guide portion 133 may include a plurality of guide grooves 1331 formed thereon.

The second part 222 includes a guide projection 2224 corresponding to the guide groove 1331, and includes a plurality of guide projections 2224 that are inserted into the plurality of guide grooves 1331.

The plurality of guide projections 2224 is slidably inserted into the plurality of guide grooves 1331. Through this, the second part 222 may move up and down along the plurality of guide grooves 1331 in a state where it is supported by the second elastic member 225. That is, the second part 222 may reciprocate in the third direction or the fourth direction along the plurality of guide grooves 1331.

As illustrated in FIG. 6A, in a standby state, the first part 221 receives an elastic force that is applied from the elastic member 224 to maintain a state where one end portion 2211 is rotated to project onto the conveyance path P1. In addition, the second part 222 is supported by the second elastic member 225, and the light blocking member 2223 that is inserted into the light sensing area A blocks the light irradiated from the light emitting portion 112 toward the light receiving portion 113.

Thereafter, as illustrated in FIG. 6B, if one end portion 2221 of the first part 221 is pressed as the paper moves along the moving direction S, the first part 221 is rotated in the first direction.

Since the first part 221 is rotated in the first direction, the pressing member 2213 presses the other end portion 2222 of the second part 222 in a downward direction.

Accordingly, the second part 222 moves in the third direction along the plurality of guide grooves 1331. Through this, the light blocking member 2223 moves in the third direction in which it extracts from the light sensing area A, and releases the blocking of the light irradiated from the light emitting portion 112 toward the light receiving portion 113.

While the paper passes through the conveyance path P1, the first lever 221 maintains a state where it is rotated at a third angle $\alpha+\beta$, and the second part 222 maintains a state where it has moved downward.

Thereafter, if the whole paper has passed through the conveyance path P1, the pressing of the one end portion 2211 of the first part 221 is released, and the first part 221 is rotated in the second direction as large as the third angle $\alpha+\beta$ by the elastic force of the first elastic member 224.

In addition, the second part 222 is released from the pressing by the pressing member 2213, and moves in an upward direction, that is, in a fourth direction, by the elastic force of the second elastic member 225. Accordingly, the light blocking member 2223 is again inserted into the light sensing area A to block the light irradiated from the light emitting portion 112 toward the light receiving portion 113.

Through this, the paper sensor 100' may return to the standby state.

As described above, the paper sensor 100' is configured so that the second part 222 moves straight in the vertical direction against the installation surface of the main body 10, and the moving distance of the second part 222 may be set to the minimum distance in which the light blocking member 2223 can selectively block the light.

Through this, a compacter paper sensor 100' can be configured.

Figure 7:
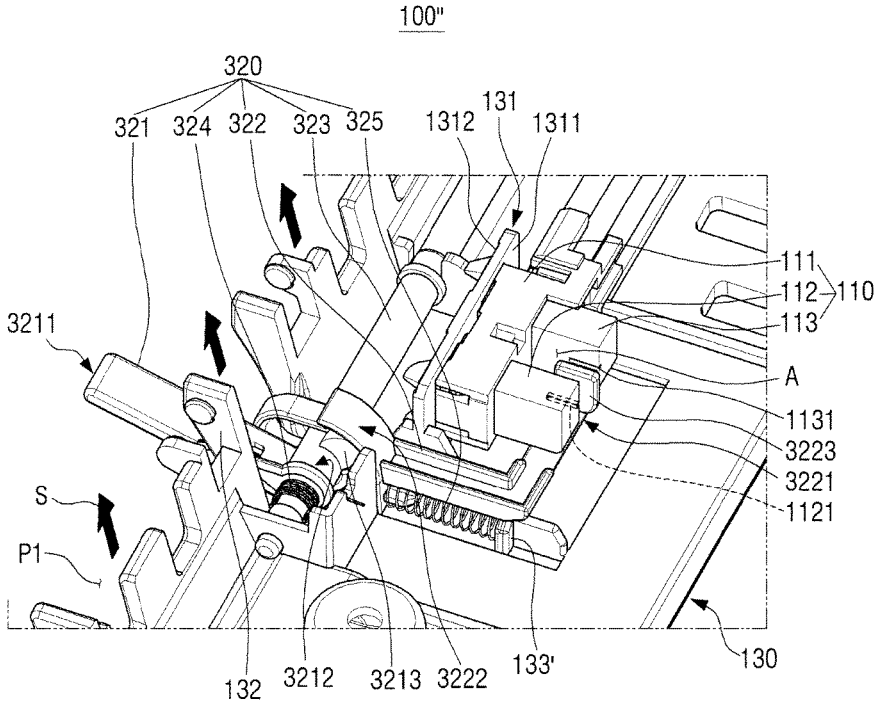
FIG. 7 is an enlarged perspective view of an interior of an image forming apparatus including a paper sensor according to still another embodiment of the present disclosure.
Figure 8A:
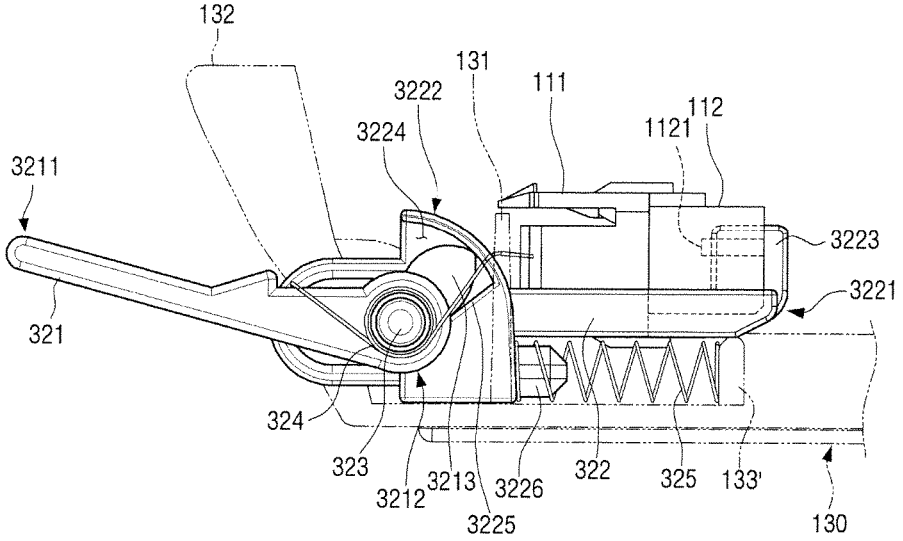
FIGS. 8A and 8B are side views explaining an operation process of a paper sensor as illustrated in FIG. 7.
Figure 8B:
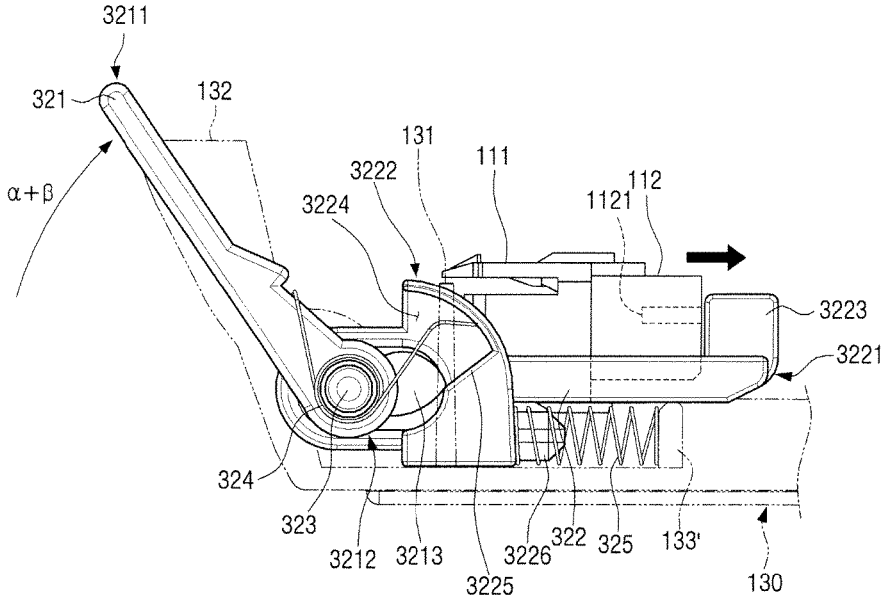

FIG. 7 is an enlarged perspective view of an interior of an image forming apparatus 1 including a paper sensor 100" according to still another embodiment of the present disclosure, and FIGS. 8A and 8B are side views explaining an operation process of a paper sensor 100" as illustrated in FIG. 7.

Hereinafter, referring to FIGS. 7 to 8B, a paper sensor 100" according to still another embodiment of the present disclosure will be described.

Since the most configurations of the paper sensor 100" according to still another embodiment of the present disclosure are the same as those of the paper sensor 100 as illustrated in FIGS. 2 and 3, a duplicate explanation thereof will be omitted, and explanation will be made around the difference from the paper sensor 100 according to an embodiment of the present disclosure.

The paper sensor 100" includes a sensor 110 and a lever 320, and the sensor 110 is the same as the sensor 110 as illustrated in FIGS. 2 and 3.

The lever 320 includes a first part 321 configured to be pressed by the paper passing through the conveyance path P1 to be rotated, a second part 322 configured to interlock with the first part 321 to selectively block the light irradiated from the light emitting portion 112 toward the light receiving unit 113, and a rotating shaft 323 to which the first part 321 are rotatably connected.

One end portion 3211 of the first part 321 may be arranged on the conveyance path P1 to be pressed by the paper passing through the conveyance path P1, and through this, the first part 321 may be rotated around the rotating shaft 323 in the first direction.

In addition, the lever 320 further includes a first elastic member 324 configured to apply an elastic force to the first part 321 so that the first part 321 is rotated in the second direction that is opposite to the first direction.

A pressing member 3213 that projects toward the second part 322 is arranged on the other end portion 3212 of the first part 321.

If the first part 321 is rotated in the first direction by the paper passing through the conveyance path P1, the pressing member 3213 may press the second part 322, and through this, the second part 322 may move in a direction in which a part of the second part 322 inserted into the light sensing area A extracts from the light sensing area A.

The second part 322 includes a light blocking member 3223 arranged on one end portion 3221 of the second part 322, and the light blocking member 3223 is formed to project in a direction that is directed from the one end portion 3221 of the second part 322 toward the light sensing area A so as to be inserted into the light sensing area A.

In addition, the second part 322 further includes a hole 3224 formed on the inside of the other end portion 3222 to receive the pressing member 3213 that is inserted into the hole 3224.

The hole 3224 may be in a fan shape around the rotating shaft 323, and the pressing member 3213 inserted into the hole 3224 may be rotated in the first direction to press the other end portion 3222 of the second part 322 along the hole 3224.

Specifically, on the inside of the hole 3224, an inclined surface 3225 capable of coming in contact with the rotating pressing member 3213 to be pressed may be formed. Accordingly, as the pressing member 3213 is rotated in the first direction to press the inclined surface 3225, the second part 322 may move in a horizontal direction in which it goes far from the other end portion 3212 of the first part 321.

Through this, the second part 322 may move in a direction in which the light blocking member 3223 extracts from the light sensing area A.

As illustrated in FIGS. 8A and 8B, the second part 322 may move in a third direction in which the light blocking member 3223 extracts from the light sensing area A and a fourth direction that is opposite to the third direction, and the third and fourth directions may be set to a horizontal direction against the installation surface of the main body 10.

In addition, the second part 322 is coupled to the second elastic member 325 that applies an elastic force in the horizontal direction based on the installation surface of the main body 10.

The support member 130 includes a support 133' supporting one end of the second elastic member 325 arranged in the horizontal direction, and the other end of the second elastic member 325 is connected to the second part 322. The second part 322 may further include a coupling projection 3226 to which the other end of the second elastic member 325 is coupled.

Through this, the second elastic member 325 may apply an elastic force to the second part 322 so that the second part 322 moves in a fourth direction.

Accordingly, the second part 322 may reciprocate in the third and fourth directions in a state where it is coupled to the second elastic member 325. In addition, the support member 130 may further include a guide portion (not illustrated) configured to guide the movement of the second part 322 in the horizontal direction.

As illustrated in FIG. 8A, in a standby state, the first part 321 receives an elastic force that is applied from the first elastic member 324 to maintain a state where one end portion 3211 is rotated to project onto the conveyance path P1. In addition, the second part 322 maintains a state where it moves in the fourth direction by the second elastic member 325, and the light blocking member 3223 that is inserted into the light sensing area A blocks the light irradiated from the light emitting portion 112 toward the light receiving portion 113.

Thereafter, as illustrated in FIG. 8B, if one end portion 3221 of the first part 321 is pressed as the paper moves along the moving direction S, the first part 321 is rotated in the first direction.

Since the first part 321 is rotated in the first direction, the pressing member 3213 presses an inclined surface 3225 along the hole 3224.

Accordingly, the second part 322 moves in the third direction, and through this, the light blocking member 3223 moves in the third direction in which it extracts from the light sensing area A, and releases the blocking of the light irradiated from the light emitting portion 112 toward the light receiving portion 113.

While the paper passes through the conveyance path P1, the first lever 321 maintains a state where it is rotated at a third angle $\alpha+\beta$ in the first direction, and the second part 322 maintains a state where it has moved in the third direction.

Thereafter, if the whole paper has passed through the conveyance path P1, the pressing of the one end portion 3211 of the first part 321 is released, and the first part 321 is rotated in the second direction as large as the third angle $\alpha+\beta$ by the elastic force of the first elastic member 324.

In addition, the second part 322 is released from the pressing by the pressing member 3213, and moves in the fourth direction by the elastic force of the second elastic member 325. Accordingly, the light blocking member 3223 is again inserted into the light sensing area A to block the light irradiated from the light emitting portion 112 toward the light receiving portion 113.

Through this, the paper sensor 100" may return to the standby state.

As described above, the paper sensor 100" is configured so that the second part 322 moves straight in the horizontal direction against the installation surface of the main body 10, and the moving distance of the second part 322 may be set to the minimum distance in which the light blocking member 3223 can selectively block the light.

Through this, a compacter paper sensor 100" can be configured.

Although the preferred embodiments of the present disclosure have been individually described as described above, it is not necessary that the respective embodiments are singly implemented, but the configurations and operations of the respective embodiments may be implemented in combination with at least one other embodiment.

The foregoing exemplary embodiments and advantages are merely exemplary and are not to be construed as limiting the present disclosure. The present teaching can be readily applied to other types of apparatuses. Also, the description of the exemplary embodiments of the present disclosure is intended to be illustrative, and not to limit the scope of the claims, and many alternatives, modifications, and variations will be apparent to those skilled in the art.

What is claimed is:

1. An image forming apparatus comprising:

a main body;

a fan to discharge air from inside the main body to outside of the main body; and a paper sensor arranged between the fan and a conveyance path of paper that has passed through a fuser of the image forming apparatus, and to sense the paper passing through the fuser, the paper sensor including:

a sensor including a body portion having:

a first surface facing the conveyance path to block a flow of the air inside the main body moving from the conveyance path toward light sensing area of the paper sensor open toward the fan, a second surface facing toward the fan and away from the conveyance path, and a light emitting portion and a light receiving portion arranged on the second surface to be spaced apart from each other and to face each other, the light sensing area provided between the light emitting portion and the light receiving portion.

2. The image forming apparatus as claimed in claim 1, wherein the paper sensor further comprises:

a lever to be moved by the paper passing through the conveyance path to selectively block light irradiated from the light emitting portion toward the light receiving portion.

3. The image forming apparatus as claimed in claim 2, wherein the air inside the main body is directed to flow from the conveyance path toward the fan.

4. The image forming apparatus as claimed in claim 2, further comprising a support member to support the paper sensor and provided with a mount portion, arranged between the conveyance path and the sensor, to be coupled to the first surface, wherein a mount surface to which the first surface of the mount portion is coupled is to have an area that is larger than an area of the first surface.

5. The image forming apparatus as claimed in claim 2, wherein the lever comprises:

a first part to be moved by the paper passing through the conveyance path; and a second part to interlock with the first part to selectively block the light irradiated from the light emitting portion toward the light receiving portion.

6. The image forming apparatus as claimed in claim 5, wherein the first part is to rotate in a first direction around a second end portion of the first part as a first end portion of the first part arranged on the conveyance path is moved by the paper passing through the conveyance path, and the second part is moved by the first part being rotated in the first direction, so that a light blocking member that is inserted into the light sensing area moves in a direction in which the light blocking member extracts from the light sensing area.

7. The image forming apparatus as claimed in claim 6, wherein the light blocking member is coupled to a first end portion of the second part, the lever further comprises a rotatable shaft to which the second end portion of the first part and a second end portion of the second part are rotatably connected, and the second part is rotated in the same direction as the direction of the first part as the second end portion of the second part is fastened to the second end portion of the first part in accordance with the rotation of the first part.

8. The image forming apparatus as claimed in claim 7, wherein the lever further comprises an elastic member to apply an elastic force to the first part so that the first part is rotated in a second direction that is opposite to the first direction when the paper is not in contact with the lever.

9. The image forming apparatus as claimed in claim 8, wherein the light blocking member is to release blocking of the light irradiated from the light emitting portion toward the light receiving portion as the second part is rotated in the first direction, and blocks the light irradiated from the light emitting portion toward the light receiving portion as the second part is rotated in the second direction.

10. The image forming apparatus as claimed in claim 9, wherein the first part includes first and second locking portions formed on the second end portion of the first part to be arranged along an outer circumference of the rotatable shaft, and the second part includes third and fourth locking portions formed on the second end portion of the second part to be arranged between the first locking portion and the second locking portion along the outer circumference of the rotatable shaft.

11. The image forming apparatus as claimed in claim 10, wherein the first locking portion is to move and press the third locking portion so that the second part is rotated in the first direction as the first part is rotated in the first direction, and the second locking portion presses the fourth locking portion so that the second part is rotated in the second direction as the first part is rotated in the second direction.

12. The image forming apparatus as claimed in claim 11, wherein the first locking portion and the third locking portion are arranged to be spaced apart from each other at a predetermined angle on the basis of a rotation center of the rotatable shaft in a standby state so that a rotation angle of the second part is smaller than a rotation angle of the first part.

13. The image forming apparatus as claimed in claim 7, wherein the second part is extended from the rotatable shaft toward the light sensing area, and at least a part of the second part is bent toward the light sensing area.

14. The image forming apparatus as claimed in claim 6, wherein the first part includes a pressing member projecting from the second end portion of the first part toward the second part, the second part is arranged to be movable in a third direction in which the light blocking member extracts from the light sensing area and a fourth direction that is opposite to the third direction, the lever further includes an elastic member that applies an elastic force to the second part so that the second part moves in the fourth direction, and the pressing member presses the second part so that the second part moves in the third direction if the first part is rotated in the first direction.

15. The image forming apparatus as claimed in claim 14, wherein the third and fourth directions are set as a vertical direction against an installation surface of the main body or a horizontal direction against the installation surface of the main body.

16. An image forming apparatus, comprising:

a main body;

a fan to discharge air from inside the main body to outside of the main body; and a paper sensor arranged between the fan and a conveyance path of paper that has passed through a fuser of the image forming apparatus, and to sense the paper passing through the fuser, the paper sensor including:

a sensor including a body portion having:

a first surface facing the conveyance path, a second surface facing away from the conveyance path and toward the fan, a light emitting portion and a light receiving portion arranged on the second surface to be spaced apart from each other and to face each other, and a light sensing area formed between the light emitting portion and the light receiving portion, and a lever to be moved by the paper passing through the conveyance path to selectively block light irradiated from the light emitting portion toward the light receiving portion, the lever including:

a rotatable shaft, a first part having a first end coupled to the rotatable shaft and a second end to rotate about the first end of the first part when the second end of the first part is moved by the paper passing through the conveyance path, and a second part having a first end coupled to the rotatable shaft and a second end to rotate about the first end of the second part when the second end of the first part is moved by the paper passing through the conveyance path such that a light blocking member provided at the second end of the second part is withdrawn from the light sensing area.

17. An image forming apparatus, comprising:

a main body;

a fan to discharge air from inside the main body to outside of the main body; and a paper sensor arranged between the fan and a conveyance path of paper that has passed through a fuser of the image forming apparatus, and to sense the paper passing through the fuser, the paper sensor including:

a sensor including a body portion having:

a first surface facing the conveyance path, a second surface facing away from the conveyance path and toward the fan, a light emitting portion and a light receiving portion arranged on the second surface to be spaced apart from each other and to face each other, and a light sensing area formed between the light emitting portion and the light receiving portion, and a lever to be moved by the paper passing through the conveyance path to selectively block light irradiated from the light emitting portion toward the light receiving portion, the lever including:

a rotatable shaft, a first part having a first end coupled to the rotatable shaft and a second end to rotate in a first direction about the first end of the first part when the second end of the first part is moved by the paper passing through the conveyance path, a second part to move when the second end of the first part is moved by the paper passing through the conveyance path such that a light blocking member provided at the second end of the second part is withdrawn from the light sensing area, and an elastic member to apply an elastic force to the first part so that the first part is rotated in a second direction that is opposite to the first direction when the paper is not in contact with the lever.

18. The image forming apparatus as claimed in claim 17, wherein the first part includes a pressing member projecting from the second end of the first part toward the second part to press the second part such that when the second end is rotated in the first direction the second part moves in a third direction and the light blocking member provided at the second end of the second part is withdrawn from the light sensing area.

19. The image forming apparatus as claimed in claim 18, wherein the second part is movable in a fourth direction in which the light blocking member is inserted into the light sensing area when the second part is released from the pressing by the pressing member.

20. The image forming apparatus as claimed in claim 19, wherein the lever includes another elastic member to apply an elastic force to the second part so that the second part moves in the fourth direction when the second part is released from the pressing by the pressing member.

* * * * *